US008910819B2

(12) United States Patent
Seiders

(10) Patent No.: US 8,910,819 B2
(45) Date of Patent: Dec. 16, 2014

(54) INSULATING CONTAINER AND LATCHING MECHANISM

(75) Inventor: Roy Joseph Seiders, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 13/304,739

(22) Filed: Nov. 28, 2011

(65) Prior Publication Data

US 2012/0132657 A1 May 31, 2012

Related U.S. Application Data

(60) Provisional application No. 61/458,603, filed on Nov. 29, 2010.

(51) Int. Cl.

| | |
|---|---|
| ***B65D 45/18*** | (2006.01) |
| ***B65D 45/22*** | (2006.01) |
| ***E05C 3/04*** | (2006.01) |
| ***E05B 65/52*** | (2006.01) |
| *B65D 81/38* | (2006.01) |
| *E05B 15/16* | (2006.01) |
| *E05B 1/00* | (2006.01) |

(52) U.S. Cl.

CPC ..... *B65D 81/3816* (2013.01); *E05B 2015/165* (2013.01); *E05C 3/048* (2013.01); *E05B 2015/1678* (2013.01); *E05B 1/0053* (2013.01); *E05B 65/5276* (2013.01)

USPC ..... 220/326; 220/592.2; 220/835

(58) Field of Classification Search

USPC ..... 220/324, 833, 834, 592.2, 835

See application file for complete search history.

(56) References Cited

U.S. PATENT DOCUMENTS

| | | | | |
|---|---|---|---|---|
| D2,237 | S | 12/1865 | Richardson | |
| 1,087,167 | A * | 2/1914 | Groehn | 220/324 |
| 1,483,953 | A * | 2/1924 | Rainey | 220/326 |
| 1,490,575 | A * | 4/1924 | Masury et al. | 292/80 |
| 1,699,313 | A * | 1/1929 | Schlaich | 220/324 |
| 2,641,493 | A | 6/1953 | Flugarth | |
| 2,960,216 | A * | 11/1960 | Brady | 206/544 |
| 3,618,995 | A | 11/1971 | McLean | |
| 3,690,708 | A | 9/1972 | Worley et al. | |
| 3,782,765 | A | 1/1974 | Wallyn | |
| 3,782,795 | A * | 1/1974 | Richey et al. | 384/463 |
| D257,218 | S | 10/1980 | Eriksson | |
| D278,502 | S | 4/1985 | Powell, Jr. | |
| D289,850 | S | 5/1987 | Olson | |
| 4,702,504 | A | 10/1987 | Brothers | |
| D297,813 | S | 9/1988 | Marx | |
| 4,804,215 | A | 2/1989 | Bisbing | |

(Continued)

OTHER PUBLICATIONS

Southco 37 Draw Latch Flyer.

(Continued)

*Primary Examiner* — Mickey Yu
*Assistant Examiner* — Niki Eloshway
(74) *Attorney, Agent, or Firm* — Banner & Witcoff, Ltd.

(57) ABSTRACT

According to an aspect of the invention, a latching mechanism/device is provided, as well as a method of maintaining a closed position between opposing first and second portions of a container. The latching mechanism includes a latch attached to the first portion and a latch keeper integrally molded to the second portion. The latch keeper includes an elongated keeper slot and a recessed pocket formed in the keeper slot, such that when at least a portion of the latch is received within the recessed pocket, the container is closed and/or sealed.

33 Claims, 7 Drawing Sheets

(56) References Cited

U.S. PATENT DOCUMENTS

| | | | | |
|---|---|---|---|---|
| 4,828,298 | A | 5/1989 | Bisbing | |
| 4,830,413 | A | 5/1989 | Bisbing | |
| D314,683 | S | 2/1991 | Scanland | |
| D333,775 | S | 3/1993 | Krape | |
| 5,213,381 | A | 5/1993 | Anderson | |
| D361,929 | S | 9/1995 | Weinerman et al. | |
| D364,082 | S | 11/1995 | Weinerman et al. | |
| 5,478,125 | A | 12/1995 | Gromotka | |
| D374,806 | S | 10/1996 | Ford et al. | |
| D380,369 | S | 7/1997 | Antonucci | |
| 5,735,428 | A * | 4/1998 | Chern | 220/324 |
| 5,738,238 | A * | 4/1998 | Yang | 220/324 |
| 5,984,383 | A | 11/1999 | Parikh et al. | |
| D427,882 | S | 7/2000 | Wytcherley et al. | |
| D435,780 | S | 1/2001 | Tieu | |
| 6,182,462 | B1 | 2/2001 | Bania et al. | |
| D454,292 | S | 3/2002 | Plummer et al. | |
| 6,398,272 | B1 | 6/2002 | Plummer et al. | |
| D469,681 | S | 2/2003 | Votruba et al. | |
| D491,440 | S | 6/2004 | Pfeiffer et al. | |
| D491,796 | S | 6/2004 | Eriksson | |
| D491,797 | S | 6/2004 | Eriksson | |
| D584,594 | S | 1/2009 | Marko | |
| D590,694 | S | 4/2009 | Stuckey | |
| 7,540,364 | B2 * | 6/2009 | Sanderson | 190/119 |
| D602,347 | S | 10/2009 | Allen | |
| 8,186,728 | B2 | 5/2012 | Kopylov | |
| D699,100 | S | 2/2014 | Moreau et al. | |
| 2008/0110892 | A1 * | 5/2008 | House | 220/324 |
| 2009/0139245 | A1 * | 6/2009 | Blackway et al. | 62/3.62 |

OTHER PUBLICATIONS https://web.archive.org/web/20080530173551/http://www.alltackle.com/fish_coolers.htm, downloaded on May 21, 2014, depicting prior art products on sale in this country on May 30, 2008, 8 pages.

https://web.archive.org/web/20080530173902/http://www.alltackle.com/yeti_fish_coolers.htm, downloaded on May 21, 2014, depicting prior art products on sale in this country on May 30, 2008, 5 pages.

https://webarchive.org/web/20081224163250/http://www.alltackle.com/icey_tek_fish_coolers.htim, downloaded on May 21, 2014, depicting prior art products on sale in this country on Dec. 24, 2008, 5 pages.

Photographs showing design of prior art product sold in this country on May 30, 2008, 22 pages.

Photographs showing design of prior art product sold in this country on May 30, 2008, 2 pages.

Excerpt of prior art publication available on Aug. 8, 2008 showing design of prior art product sold in this country on Aug. 8, 2008, 1 page.

* cited by examiner

INSULATING CONTAINER AND LATCHING MECHANISM

CROSS-REFERENCE TO RELATED APPLICATIONS

This application claims priority to U.S. Provisional Application No. 61/458,603 filed Nov. 29, 2010, and incorporated herein by reference in its entirety.

FIELD OF THE INVENTION

The invention generally relates to a latching mechanism/device for maintaining a closed position, particularly useful for maintaining a closed position for an insulating container.

BACKGROUND OF THE INVENTION

Mechanisms for maintaining a closed position useful for containers, chests, closets, doors, windows, coolers and the like are well known in the art. There are problems associated with such mechanisms, however, in the form of components that are breakable by virtue of their positioning and/or their composition.

One such prior latch is found in U.S. Pat. No. 4,804,215 to Bisbing which describes a locking member made from a flexible, resilient material, but wherein both the locking member and the keeper are attached to and extend from a surface of a panel. Such mechanisms are easily bumped and broken away from the panel. Further, the keeper is made of stamped metal construction. Such materials are known to exhibit wear and corrode over time, particularly if subjected to harsh environmental conditions as found in a maritime environment.

An example of such an arrangement of latch and keeper is found, for instance in FIGS. 2 and 3, wherein both a latch and latch keeper are each riveted, screwed, bolted or otherwise attached to a container via a metallic mounting bracket that is bolted to the container. Such brackets are easily broken and fail over time because of both the materials of construction (typically metal), as well as the arrangement of the brackets on the container. These mounting brackets protrude from the surface of the container and are thus easily broken off when a force of sufficient strength strikes or otherwise adversely engages the bracket.

Closing mechanisms used in insulating containers, such as those found on portable containers useful for maintaining a certain temperature, be it cold and/or hot temperatures, of items, goods or contents stored therein are particularly troublesome due to the typically rough handling, as well as the harsh environmental conditions, these containers are subjected to. Not only are such containers, generally known as "coolers", used in extremely hot and/or cold environments, but are also used on beaches and boats where salt and sand provide a beating to both the container and the latching device. The containers may also be routinely jostled, buffeted about and otherwise abused. Without the ability to maintain closure, such containers cannot effectively achieve their purpose and quickly become obsolete and unusable.

In view of the disadvantages associated with currently available methods and devices for providing a closing mechanism to a container such as a cooler, there is a need for a device and method that overcomes these and other deficiencies.

SUMMARY OF THE INVENTION

The above mentioned need is met by the invention which provides a latching mechanism/device, as well as a method of maintaining a closed position between opposing first and second portions of a container. The latching mechanism includes a latch attached to the first portion and a latch keeper integrally molded to the second portion. The latch keeper includes an elongated keeper slot and a recessed pocket formed in the keeper slot, such that when at least a portion of the latch is received within the recessed pocket, the container is closed and/or sealed.

The invention and its advantages over the prior art will become apparent upon reading the following detailed description and the appended claims with reference to the accompanying drawings.

BRIEF DESCRIPTION OF THE FIGURES

A full and enabling disclosure of the invention, including the best mode thereof, to one of ordinary skill in the art, is set forth more particularly in the remainder of the specification, including reference to the accompanying figures wherein.

DETAILED DESCRIPTION OF THE PREFERRED EMBODIMENTS

Figure 1:
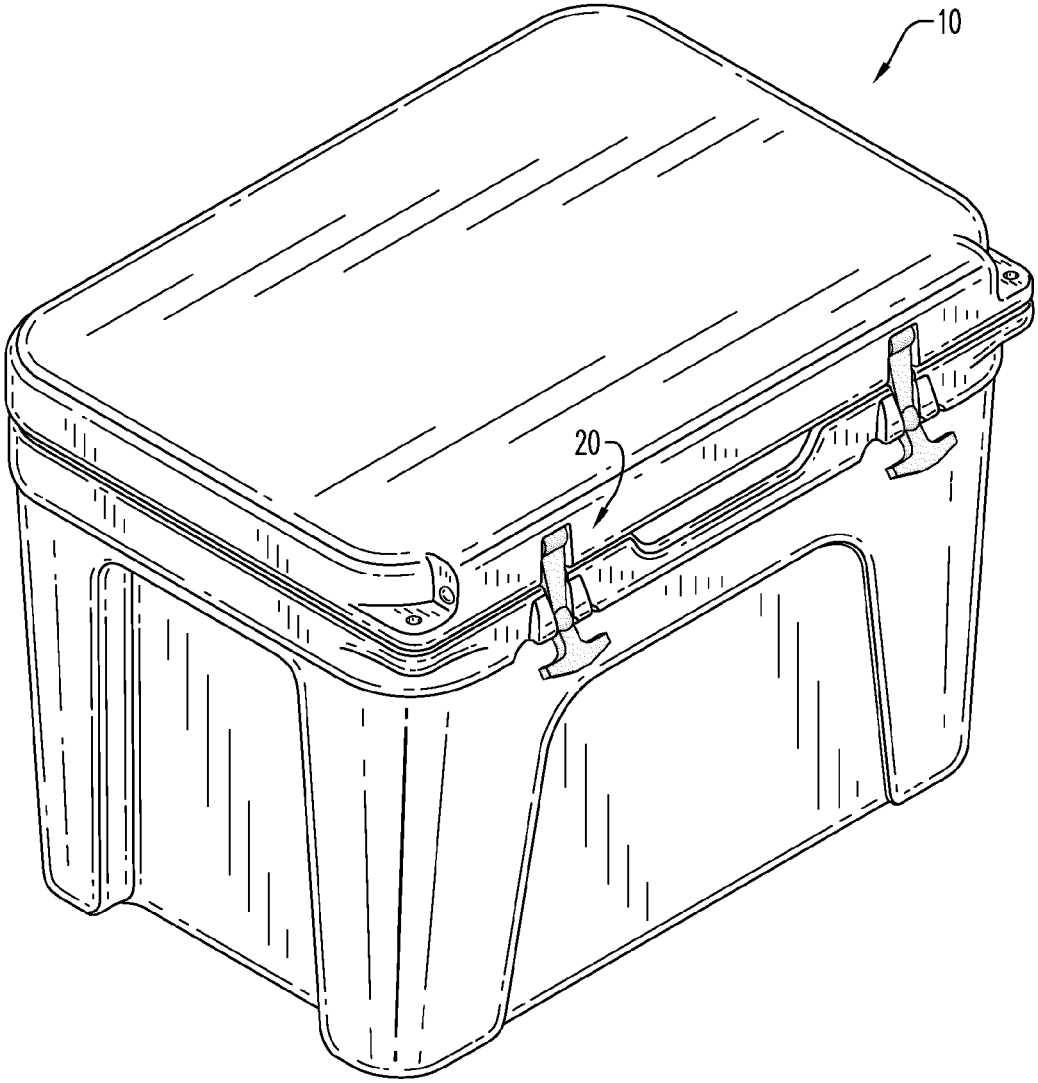
FIG. 1 is a perspective view of an insulating container according to one embodiment of the invention.
Figure 2:
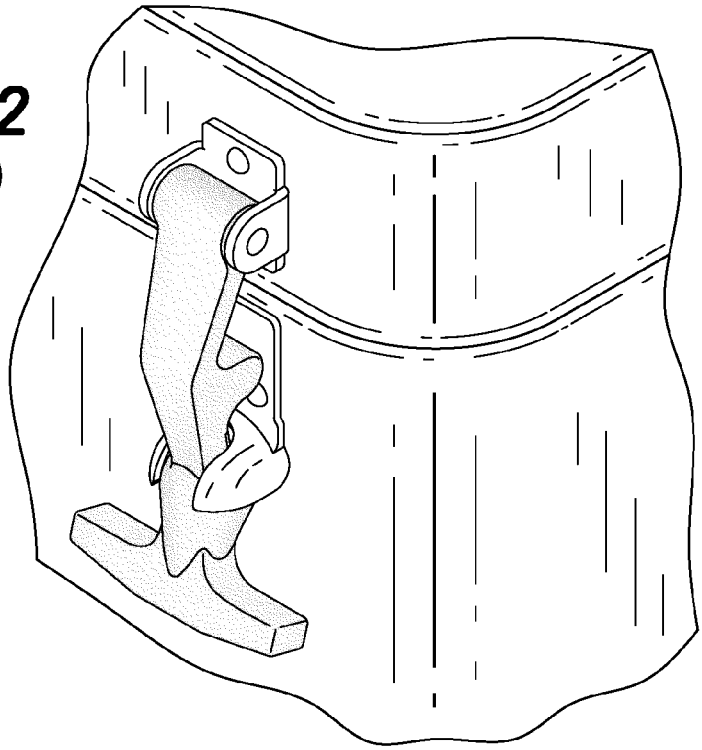
FIG. 2 (PRIOR ART)
FIG. 2 is a partial perspective view of a prior latching mechanism.
Figure 3:
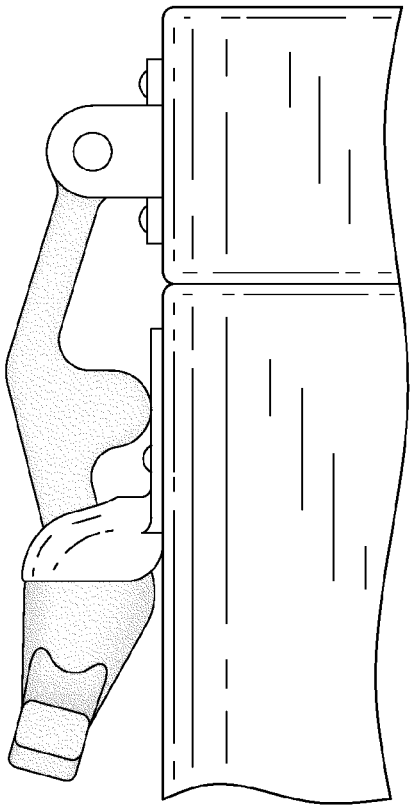
FIG. 3 (PRIOR ART)
FIG. 3 is a right side elevation view of the latching mechanism shown in FIG. 2.

Reference will now be made in detail to the presently preferred embodiments of the invention, one or more examples of which are illustrated in the drawings. Each example is provided by way of explanation of the invention, and is not meant as a limitation of the invention. For example, features illustrated or described as part of one embodiment can be used on or in conjunction with other embodiments to yield yet a further embodiment. It is intended that the invention include such modifications and variations. Reference characters denote like elements throughout the figures and text.

Figure 6:
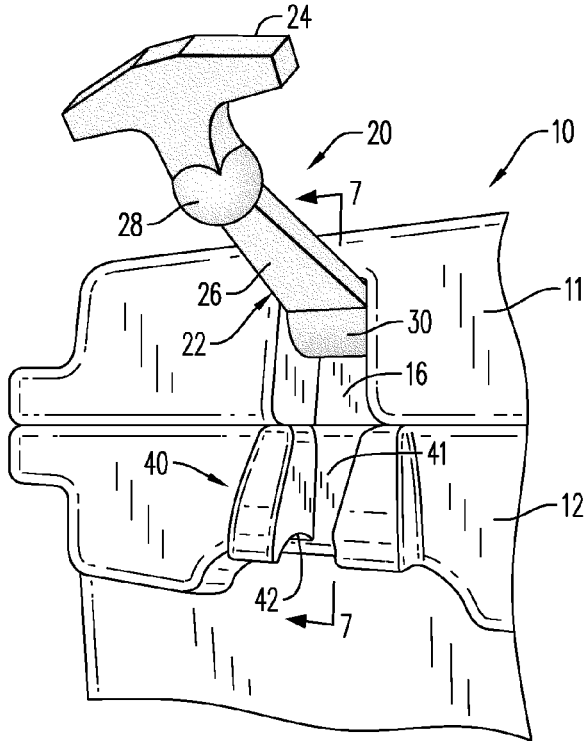
FIG. 6 is a partial perspective view of the latching mechanism according to one aspect of the invention.
Figure 7:
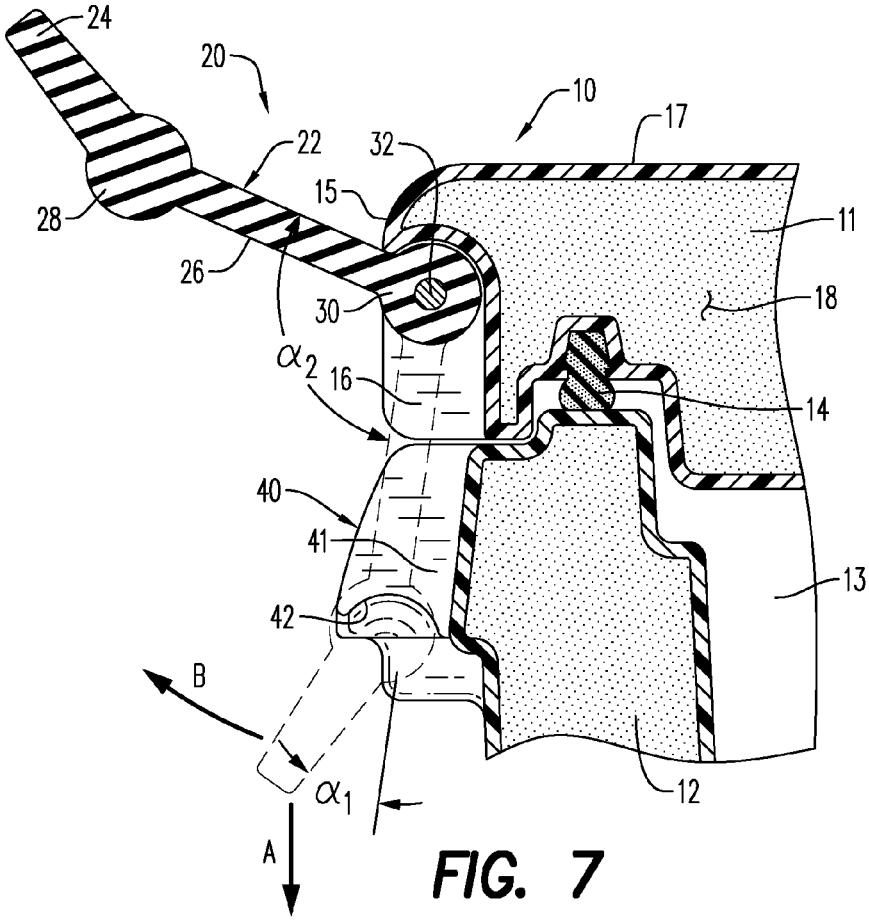
FIG. 7 is a cross-sectional right side view taken along line 7-7 of FIG. 6.

In an embodiment of the invention, a latching device or mechanism and a method for maintaining a closed and/or sealed position between first and second portions is provided. Such portions include opposing surfaces such as those found for instance in containers, chests, closets, doors, windows, coolers and the like, hereinafter collectively referred to as "container." Referring to the drawings wherein identical reference numerals denote the same or equivalent elements throughout the various views, FIGS. 1 and 4-7 depict a container 10 configured for receiving and storing contents, items, goods, (hereinafter collectively referred to as "contents"), within an interior chamber 13 (FIG. 7).

The insulating container 10, as shown in FIG. 1, includes a latching mechanism 20, and as shown herein, there are two latching mechanisms. With reference to FIGS. 6 and 7, a latching mechanism 20 is configured to maintain a closed and/or sealed position between opposing first or top portion 11 and second or bottom portion 12, thereby enclosing the interior chamber 13 for storing goods at a temperature other than an exterior ambient temperature. The latching mechanism 20 includes a latch 22 and a latch keeper 40.

In an embodiment, the top portion 11 is selectively removable from the bottom portion 12 of the container 10, preferably hinged on one side using a hinging mechanism (not shown), while providing a latching mechanism 20 opposite the hinging mechanism for securing the top portion 11 to the bottom portion 12, thereby enclosing the contents in the interior chamber 13 that desirably are maintained and stored at hot or cool temperatures, and maintaining a certain temperature within the container 10 for a certain period of time. In a typical arrangement, each of the top and bottom portions are hinged on one side and at least one latching mechanism(s) secure the portions together at another side, preferably opposite to the hinge.

The interior chamber 13 of the container 10 is configured to receive contents to be kept at the desired temperature. In other words, the contents are stored and maintained within the container at temperatures that are hotter or colder than ambient temperatures found outside of the container. In an embodiment, the container 10 is configured for storing contents that need to be kept at a cool temperature, maybe even freezing temperatures.

The container 10 includes the first or top portion 11, which may be configured as a lid, and the second or bottom portion 12, which is typically configured to receive the contents to be stored and cooled/heated in the interior chamber 13 formed therein. The container 10 may generally take the shape of a box, but is not limited thereby. In an embodiment, the container 10 is an insulated container, such as a cooler, ice chest, ice cooler, and the like. In another embodiment, the first or top portion 11 opposes second or bottom portion 12 and are generally configured to abut each other when positioned in a "closed position."

In an embodiment as depicted in FIG. 7, the top portion 11 and bottom portion 12 are formed to include an outer shell 17 surrounding and enclosing an insulating portion 18. The shell 17 is typically formed from a plastic material, such as polyethylene, that is molded to form both the top and bottom portions. In an embodiment, the insulating portion 18 is typically polyurethane foam. In a preferred embodiment, the first and second portions are formed using a roto-molded process as would be understood by one of ordinary skill in the art (not shown).

The insulated container, as well as the latching mechanism as described in more detail below, is thus easily and efficiently manufactured into a durable and reliable construction capable of withstanding harsh environments and rough handling as described hereinabove.

In an embodiment according to one aspect of the invention and as best viewed in FIG. 7, the container is configured such that a sealing portion 14 is situated between the first portion 11 and the second portion 12. The sealing portion 14 is configured for compression to maintain the closed position and to seal the top portion 11 to the bottom portion 12 of the container 10 when in the closed position and when the latch 22 is situated within the latch keeper 40 as described in more detail below.

Figure 9:
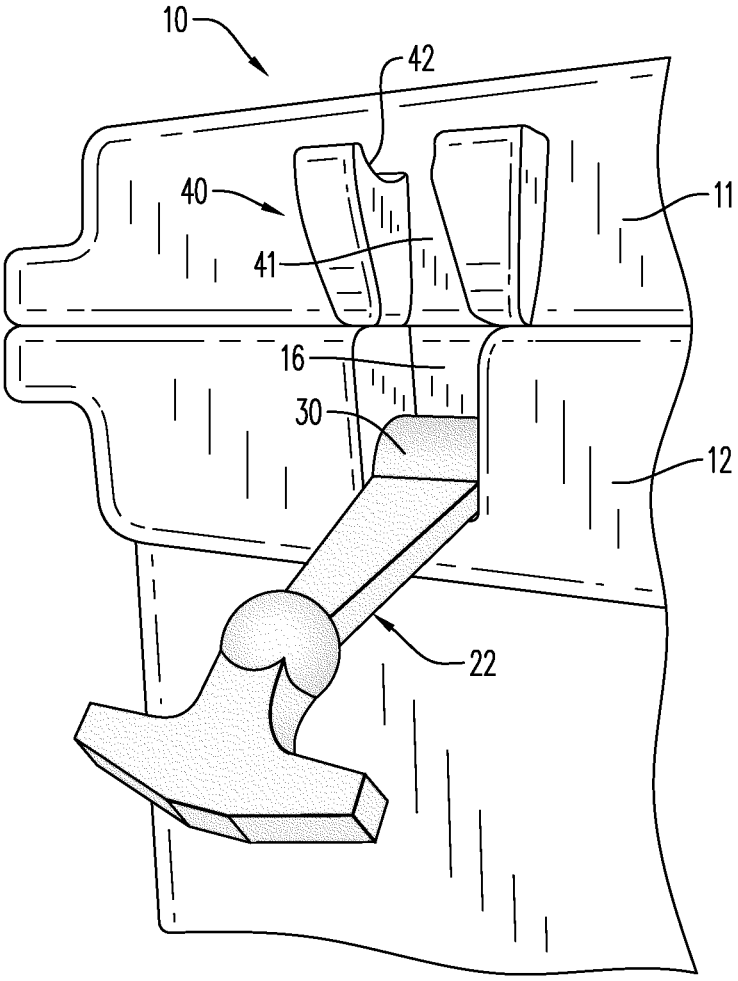
FIG. 9 is a partial perspective view of the mounting mechanism according to one aspect of the invention.

The latch 22 is attached to either the upper portion 11 (FIG. 6), or the lower portion 12 (FIG. 9), while the latch keeper 40 is integrally molded to the lower portion 12 (FIG. 6) or the upper portion 11 (FIG. 9). In other words, the latch 22 and the latch keeper 40 are interchangeably positionable on either of the opposing portions, and the terminology first/top/upper and second/bottom/lower is not intended to limit the disclosure or represent anything other than a way to describe the positional relationship of the portions.

With reference again to FIGS. 6 and 7, the latch 22 is configured to be releasably engageable with the latch keeper 40 such that when the latch 22 is in an engaged relationship with the keeper 40, the opposing first portion 11 and second portion 12 are maintained in the closed and/or sealed position. In an embodiment, the latch 22 includes a base portion 30, a body portion 26 extending from the base portion 30, an engaging portion 28 extending from the body portion 26 and a grasping portion 24 extending from the engaging portion 28. In other words, the base portion 30 of the latch 22 is arranged on one end of the latch, while the grasping portion 24 is arranged on the opposite distal end of the latch 22. The engaging portion 28 is configured for locking, mating relationship with a recessed pocket or notched area 42 of the latch keeper 40 as will be discussed in more detail below.

As shown for instance in FIG. 7, an upper edge of the first portion 11 forms a lip 15, and below the lip is a recess or latch slot 16, that is typically integrally formed into the surface of the first portion 11. The latch slot 16 is configured for receiving the latch 22. As shown in FIG. 7, the base portion 30 of the latch 22 abuts the lip 15, and at least a portion of the body portion 26 of the latch 22 is received within the latch slot 16 when the latch 22 is engaged with the latch keeper 40. The base portion 30 is typically configured for pivoting within the latch slot 16.

According to one aspect of the invention, the latch 22 is made of a flexible, stretchable, resilient, one-piece molded material that is typically pivotally attached to the first portion 11 of the container 10 and received within a recessed, elongated latch slot 16 which is typically integrally molded to the container 10. The latch 22 is typically molded in a single-piece construction from rubbery materials as would be understood by those of ordinary skill in the art. The latch 22 may be formed of a material that is formed or made from a plastics material or another suitable material which can be formed or molded into a shape and thus retain the shape to which it has been formed. The latch 22 needs to be made of sufficient size, thickness and materials of construction to withstand repeated cycles of stress as the latch is engage/disengaged with the latch keeper over time. In any case, the material of construction is one that is stretchable and/or resilient (e.g. EPDM or Neoprene rubber) such that when the latch 22 is extended or otherwise stretched to an elongated position, either to engage or disengage the latch keeper 40 (as described in more detail below), it rebounds or otherwise returns to its originally unstretched state or partially stretched state to maintain sufficient tension to maintain the closed position, with little or no deformation. In other words, the latch 22 is able to recoil or spring back or otherwise return into its original or near-original shape after bending, stretching, or being compressed and when in an un-stretched position.

In the embodiment of FIG. 7, the latch 22 is configured such that the grasping portion 24 extends from the body portion 26 at an angle $\alpha_1$ that departs from the plane of the latch 22. The angle $\alpha_1$ is preferably between about 20 and about 40 degrees, more preferably between about 30 and about 35 degrees, and more preferably about 31 degrees. Having such an angle between the grasping portion 24 and the body portion 26 facilitates grasping the latch 22 by a user. At this angle, the user is easily able to slip his or her fingers between the grasping portion 24 and the side of the second portion 12 of the container 10 for disengaging the latch 22 from the keeper 40. Further, because the latch 22 is made from a resilient material, even though the latch extends from the body of the container, it is not easily dislodged or broken.

The grasping portion 24 is typically formed into a shape that is easily grasped by a user, and as shown in the figures, the grasping portion 24 is formed into a t-shape to facilitate grasping by a user. Without intending to be limited thereby, other shapes contemplated for the grasping portion 24 include y-shaped and tab-shaped (not shown), or a small flap of material extending from the engaging portion and capable of being grasped for manipulation of the latch.

Turning to another feature of the latching mechanism 20, the latch keeper 40 is integrally molded within the second portion 12. The latch keeper 40 includes an elongated keeper slot 41 and a recessed pocket 42 formed in the keeper slot 41. The recessed pocket 42 is typically configured for receiving the engaging portion 28 of the latch 22, and the keeper slot 41 is typically configured for receiving the body portion 26 of the latch 22.

Figure 5:
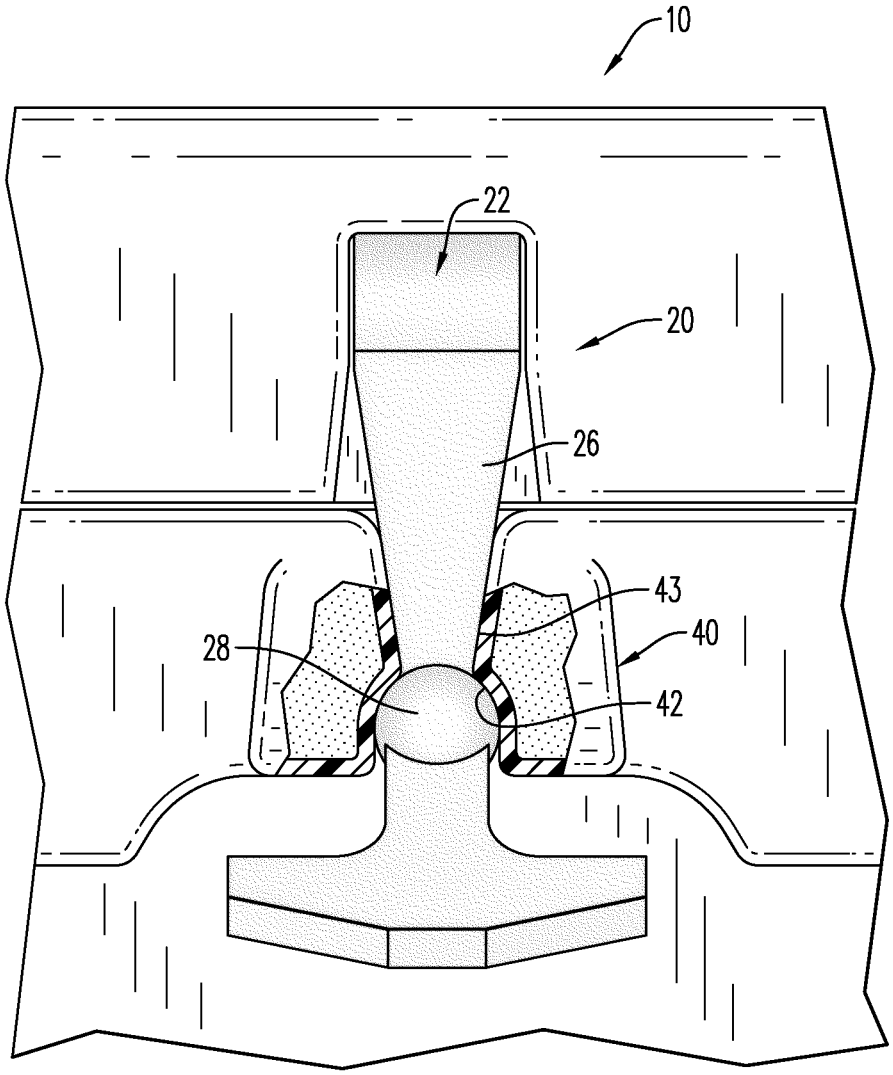
FIG. 5 is a plan view of the latching mechanism with a cut-away of an engaging portion according to one aspect of the invention.

With reference to FIG. 5 and in an embodiment, the body portion 26 of the latch 22 is formed into a cross-sectional inverted triangular shape 43 and the elongated keeper slot 41 of the latch keeper 40 is also formed/molded into a complimentary triangularly shape receiving portion to match the body portion 26 of the latch 22. In an embodiment, when the latch 22 is seated/received within the elongated keeper slot 41, the latch 22 forms a friction fit with the elongated keeper slot 41. Similarly, the body portion 26 and elongated keeper slot 41 could be formed into complimentary three dimensional pyramidal, square or rectangular shapes (not shown).

Yet another feature according to an aspect of the invention is that the engaging portion 28 of the latch 22 may be formed into a ball-shape and the recessed pocket 42 of the latch keeper 40 is configured as a complimentary shaped socket 42 to receive the ball-shaped engaging portion 28. Thus, when the engaging portion 28 is seated within the recessed pocket 42, the parts are mechanically coupled and there is an increased contact area between the surfaces of parts, which further ensures maintenance of the closed and/or sealed position. It is also contemplated that the engaging portion is capable of taking any shape that is easily received by a reciprocatingly shaped recessed pocket formed in the latch keeper. For instance, the engaging portion could be formed into any geometric shape, such as a triangle, square, and the like. Thus, the recessed pocket of the latch keeper would have a corresponding configuration capable of receiving the shaped engaging portion. In other words, the engaging portion of the latch and the recessed pocket of the latch keeper are shaped so as to be matingly coupled together. Thus, the recessed pocket has a shape configured to receive the engaging portion while providing a surface-to-surface contact area sufficient to maintain the closure.

More specifically, in an embodiment, the invention is an integrated ball and socket latching system for a portable ice chest 10. The latch keeper 40 is designed to be part of the mold of the ice chest 10 and an exact fit for the ball-shaped engaging portion 28 is molded on a stretchable rubber latch 22 having a t-shaped end. This combination provides a strong and very secure lid latching system.

Turning again to FIG. 7, the insulating container 10 typically includes lip 15 that extends from an upper edge of the top portion 11 of the container 10. The lip 15 is configured to conceal/hide/protect at least a portion of the base portion 30 of the latch 22. As seen in the figure, the lip 15 also limits the range of motion that the latch 22 can swing/pivot away from the container by an angle $\alpha_2$. As shown herein, the angle $\alpha_2$ is typically between about 90 and about 120 degrees, preferably about 95 to about 115 degrees. In addition to providing protection to the base portion 30 of the latch 22, the lip 15 also provides a more aesthetically pleasing appearance to the container 10, giving an appearance that the latch is somewhat integrated into the container.

Figure 4:
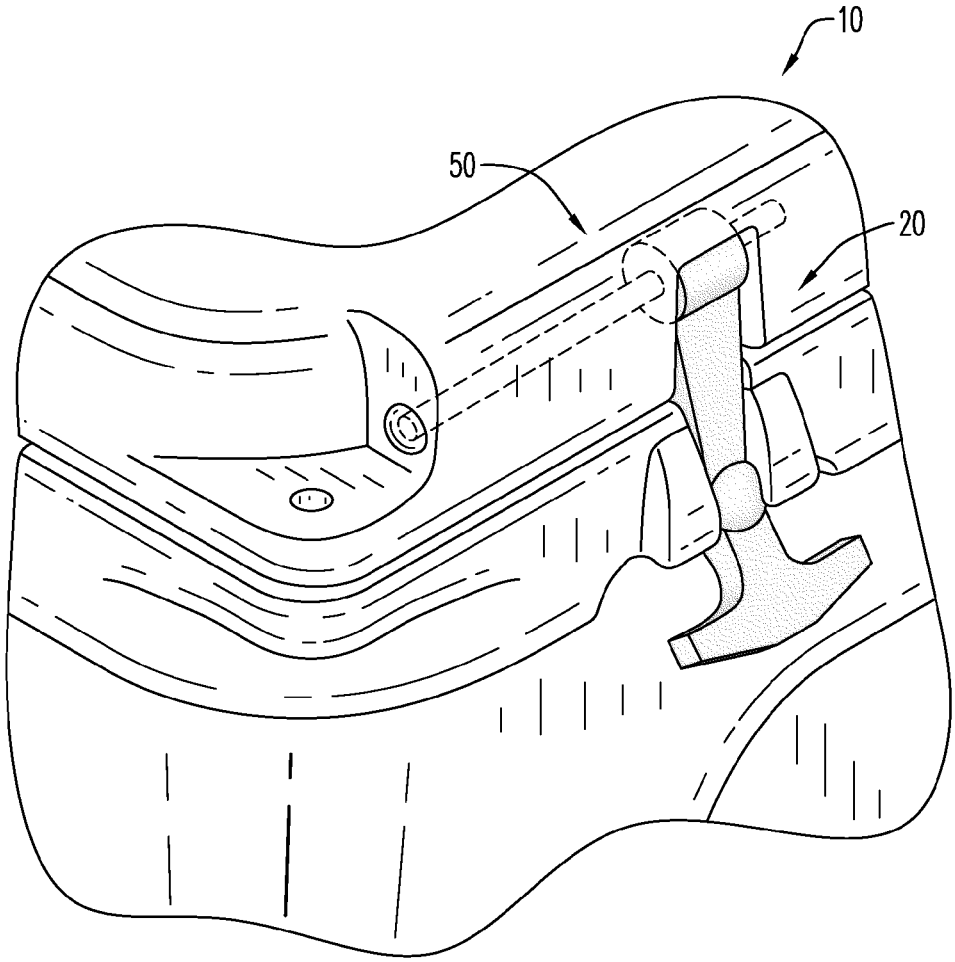
FIG. 4 is a partial perspective view of a mounting mechanism according to one embodiment of the invention.
Figure 8:
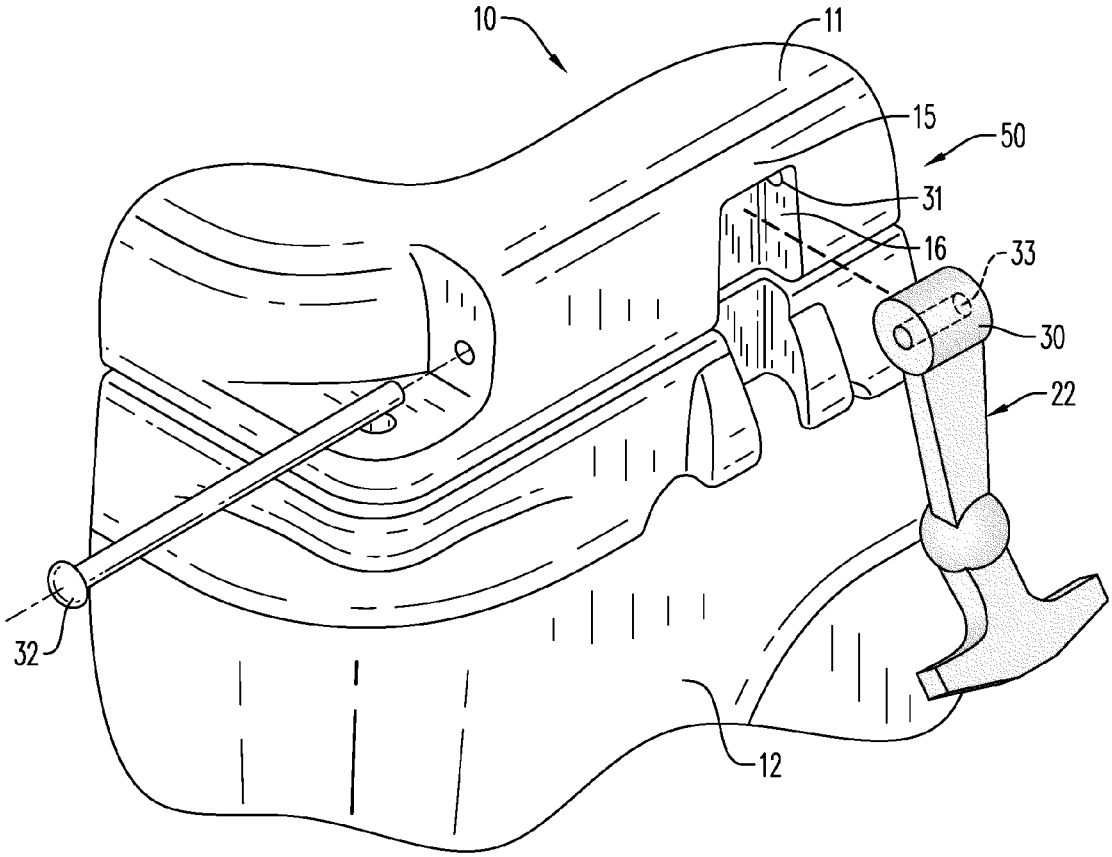
FIG. 8 is a partial perspective view of the latching mechanism according to one aspect of the invention.

According to another aspect of the invention and as found in FIGS. 4 and 8, a mounting mechanism 50 is provided for releasable attachment of the latch 22 to the container 10. As seen for instance in FIG. 8, a retaining mechanism 32, shown herein as an elongated pin, is configured to be inserted into and received within a bore or cavity 31 formed in the first portion 11 of the container 10. Similarly, the base portion 30 of the latch 22 includes a latch bore or cavity 33. Thus, when the base portion 30 of the latch 22 is positioned within the latch slot 16 with the base portion abutting an inner surface of the lip 15, the latch bore 33 aligns with the cavity 31 in the first portion 11, such that when the retaining mechanism 32 is positioned within the end of the latch slot 16 and the base portion 30, the latch 22 is pivotally attached to the first portion 11 of the container 10 (FIG. 4). In this way, the latch 22 is easily replaceable in the event that the latch wears over time.

With reference again to FIG. 7, the method of engaging and disengaging the latching mechanism will be discussed in detail. As shown with phantom lines in FIG. 7, the latch 22 is positioned in the closed position such that the first portion 11 abuts the second portion 12 of the container 10, thus closing and/or sealing the container. To disengage the latch 22, the grasping portion 24 is pulled/stretched generally in the direction shown by Arrow A. In other words, the body portion 26 of the latch 22 stretches so that the engaging portion 28 disengages from the latch keeper 40. Once the engaging portion clears the latch keeper 40, the latch 22 is swung in the direction of Arrow B, away from the container, and in the arc shown by angle $\alpha_2$. Thus, the base portion 30 pivots around the retaining mechanism 32. In the most extended position, the base portion 30 and/or the body portion 26 abuts the lip 15 of the first portion 11 to stop movement of the latch 22.

Similarly, to close the container 10, the latch 22 is moved in the direction opposite to Arrow B. When the movement of the latch 22 reaches the latch keeper 40, the latch 22 is once again extended/stretched in the direction of Arrow A and the body portion 26 of the latch 22 is seated/positioned within the keeper slot 41, preferably in a friction fit as described above. Further, as depicted in FIG. 7, when in the seated position, the body portion 26 of the latch 22 is mostly recessed within the latch slot 16 and the keeper slot 41, and does not extend or protrude beyond the surface thereof. When the stretching force is removed from the latch 22, the latch is free to attempt to return to its former state, thus allowing the engaging portion 28 of the latch 22 to become seated and received within the recessed pocket 42 of the latch keeper 40, thus closing the latching mechanism. As will be understood by one of ordinary skill in the art, the latch 22 is made of materials and sized such that when in the closed/seated position, enough force remains to maintain the closed position of the container. In other words, in the closed position, a certain amount of tension is maintained on the latch 22 as it is not completely returned to its unstretched position/state. In the closed position, the engaging portion 28 of the latch 22 is received within the recessed pocket 42 of the keeper slot 40. In a preferred embodiment, the engaging portion 28 is sized and shaped so as to provide maximum contact with the recessed pocket 42, thus ensuring an easily maintainable closure.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Exemplary embodiments of mechanisms and methods for providing a closing or latching are described above in detail. The mechanisms and methods illustrated are not limited to the specific embodiments described herein, but rather, components of the device may be utilized independently and separately from other components described herein. While the invention has been described in terms of various specific embodiments, those skilled in the art will recognize that the invention can be practiced with modification within the spirit and scope of the claims.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latching mechanism for maintaining a closed position between opposing first and second portions of a container, comprising:

a latch pivotally attached to the first portion, the latch comprising a base portion, a body portion extending from the base portion, an engaging portion extending from the body portion, and a grasping portion extending from the engaging portion;

wherein the latch comprises a flexible, stretchable, resilient, molded material, wherein the base portion of the latch is configured to be received within a recessed latch slot integrally molded within the first portion, and a retaining mechanism configured for releasable engagement positioned within the recessed latch slot;

a lip integrally molded within the first portion at an upper edge of the first portion, wherein the lip is adjacent the recessed latch slot and the base portion of the latch abuts the lip and wherein the lip is configured to limit the range of motion that the latch can pivot away from the recessed latch slot; and a latch keeper integrally molded within the second portion, the latch keeper comprising a vertically elongated keeper slot and a recessed pocket formed in the base of the keeper slot, the recessed pocket configured for receiving the engaging portion of the latch, and the keeper slot configured for receiving the body portion of the latch;

wherein the engaging portion of the latch comprises an engaging surface having a partially spherical geometric shape and the recessed pocket comprises a receiving surface having a correspondingly partially spherical geometric shape, wherein the receiving surface of the recessed pocket is configured to receive the engaging surface of the engaging portion, and wherein the receiving surface of the recessed pocket is configured to provide at least a partial surface-to-surface contact with the engaging surface of the engaging portion when the latch is engaged;

wherein when the engaging portion of the latch is engaged with the recessed pocket, at least a portion of the body of the latch is within the elongated keeper slot such that the portion of the body of the latch does not protrude beyond the elongated keeper slot.

2. The latching mechanism of claim 1, further comprising: the grasping portion of the latch forming one of a t-shape, y-shape or tab-shape.

3. The latching mechanism of claim 1, further comprising: the first and second portions of the container formed from plastic using a roto-molding process.

4. The latching mechanism of claim 1, wherein the body portion of the latch further comprises a triangular shape and the keeper slot further comprises a triangular shape complimentary to the body portion of the latch, and wherein the latch triangularly shaped body portion fits in the keeper slot triangular shape.

5. The latching mechanism of claim 1, further comprising: the engaging portion of the latch formed in a partially spherical ball-shape and the recessed pocket of the latch keeper configured as a complimentary-shaped partially spherical socket to receive the partially spherical ball-shaped engaging portion.

6. The latching mechanism of claim 1, further comprising:

a cavity formed in the first portion configured to receive a retaining mechanism for attaching the base portion of the latch to the first portion; and a lip integrally molded into the first portion, the lip configured to conceal at least a portion of the base portion of the latch.

7. The latching mechanism of claim 1, wherein the lip is configured to limit the range of motion that the latch can pivot away from the recessed latch slot by an angle of about 90 degrees to about 120 degrees.

8. The latching mechanism of claim 1, wherein the latch forms a friction fit within the keeper slot.

9. The latching mechanism of claim 1, wherein the first portion comprises a first outer shell enclosing a first insulating portion within a first interior of the first outer shell;

wherein the second portion comprises a second outer shall enclosing a second insulating portion within a second interior of the second outer shell;

the recessed latch slot integrally molded in the first outer shell, wherein the recessed latch slot comprises a first recess defined in the first outer shell such that the first recess is recessed toward the first interior and wherein the recessed latch slot is configured for receiving the body portion of the latch; and the base portion of the latch is positioned within the recessed latch slot and is attached to the first portion.

10. The latching mechanism of claim 1 wherein the recessed pocket comprises a pair of opposing recesses defined in opposing sides of the keeper slot at the base of the keeper slot.

11. The latching mechanism of claim 1 wherein the engaging portion of the comprises a front portion and a rear portion, and wherein the second portion comprises a vertical face of the container, the vertical front face extending from the base of the keeper slot to a bottom base of the container, and wherein the rear portion of the engaging portion does not contact the vertical face of the container when the latch is engaged.

12. The latching mechanism of claim 11 wherein the front portion and the rear portion of the engaging portion have a spherical geometric shape.

13. An insulating container, comprising:

a top portion, a bottom portion opposing the top portion, and a latch configured for maintaining a closed position between the top and bottom portions of the container, wherein when in the closed position, the top and bottom portions enclose an interior chamber for storing contents at a temperature other than an exterior temperature;

the top portion comprising a first outer shell enclosing a first insulating portion within a first interior of the first outer shell;

the bottom portion comprising a second outer shell enclosing a second insulating portion within a second interior of the second outer shell;

a recessed latch slot integrally molded in the first outer shell, wherein the recessed latch slot comprises a first recess defined in the first outer shell of the top portion, wherein the first recess is recessed toward the first interior and wherein the recessed latch slot is configured for receiving the body portion of the latch;

the base portion of the latch is positioned within the recessed latch slot and is attached to the top portion;

the latch pivotally attached to the top portion, the latch comprising a base portion, a body portion extending from the base portion, an engaging portion extending from the body portion, and a grasping portion extending from the engaging portion;

a latch keeper integrally molded within the bottom portion, the latch keeper comprising a vertically elongated keeper slot and a recessed pocket formed in the keeper slot, the recessed pocket configured for receiving the engaging portion of the latch, and the keeper slot configured for receiving the body portion of the latch;

wherein the engaging portion has a geometric shape and the recessed pocket is shaped to receive the geometric shape and to provide at least a partial surface-to-surface contact with the geometric shape of the engaging portion when engaged; and a lip extending from an upper edge of the top portion of the container, the lip configured to conceal at least a portion of the base portion of the latch.

14. The insulating container of claim 13, further comprising:

the latch comprises a flexible, stretchable, resilient, one-piece molded material.

15. The insulating container of claim 13, further comprising:

the grasping portion of the latch forming one of a t-shape, y-shape or tab-shape.

16. The insulating container of claim 13, further comprising:

the top and bottom portions of the container each formed from plastic using a roto-molding process.

17. The insulating container of claim 13, wherein the latch further comprises a triangularly shaped body portion and the keeper slot further comprises a triangular shape complimentary to the body portion of the latch, and wherein the latch triangularly shaped body portion fits in the keeper slot triangular shape.

18. The insulating container of claim 13, further comprising:

the engaging portion of the latch formed in a partially spherical ball-shape and the recessed pocket of the latch keeper configured as a complimentary partially spherical ball-shaped socket to receive the partially spherical ball-shaped engaging portion.

19. The insulating container of claim 13, further comprising:

a sealing portion configured for compression to maintain the closed position and to seal the top portion to the bottom portion of the container when in the closed position and when the latch is engaged within the latch keeper.

20. The insulating container of claim 13, further comprising:

a cavity formed in the top portion configured to receive a retaining mechanism for seating at least a portion of the base portion of the latch within the recessed latch slot.

21. The insulating container of claim 13, wherein the engaging portion of the latch comprises an engaging surface having a partially spherical geometric shape and the recessed pocket comprises a receiving surface having a correspondingly partially spherical geometric shape, wherein the receiving surface of the recessed pocket is configured to receive the engaging surface of the engaging portion, and wherein the receiving surface of the recessed pocket is configured to provide at least a partial surface-to-surface contact with the engaging surface of the engaging portion when the latch is engaged.

22. The insulating container of claim 13 wherein, when the engaging portion of the latch is engaged with the recessed pocket, at least a portion of the body of the latch is within the recessed latch slot such that the portion of the body of the latch does not protrude beyond the recessed latch slot.

23. The insulating container of claim 13, wherein the lip is integrally molded in the top portion at an upper edge of the top portion, wherein the lip is adjacent the recessed latch slot and the base portion of the latch abuts the lip.

24. The insulating container of claim 13 wherein the latch keeper comprises a second recess defined in the second outer shell of the bottom portion, wherein the second recess is recessed toward the second interior.

25. The insulating container of claim 24, wherein, when the engaging portion of the latch is engaged with the recessed pocket, at least a portion of the body of the latch is within the elongated keeper slot such that the portion of the body of the latch does not protrude beyond the elongated keeper slot.

26. The insulating container of claim 13, wherein the lip is configured to limit the range of motion that the latch can pivot away from the recessed latch slot by an angle of about 90 degrees to about 120 degrees.

27. The insulating container of claim 13 wherein the recessed pocket comprises a pair of opposing recesses defined in opposing sides of the keeper slot at the base of the keeper slot.

28. The insulating container of claim 13 wherein the engaging portion of the comprises a front portion and a rear portion, and wherein the bottom portion comprises a vertical front face of the container, the vertical front face extending from a base of the keeper slot to a bottom base of the container, and wherein the rear portion of the engaging portion does not contact the vertical front face of the container when the latch is engaged.

29. The insulating container of claim 28 wherein the front portion and the rear portion of the engaging portion have a spherical geometric shape.

30. An insulating container, comprising:

a top portion, a bottom portion opposing the top portion, and a latching mechanism configured for maintaining a closed position between the top and bottom portions of the container, wherein when in the closed position, the top and bottom portions thereby enclosing enclose an interior chamber for storing contents at a temperature other than an exterior temperature;

the top portion comprising a first outer shell enclosing a first insulating portion within a first interior of the first outer shell;

the bottom portion comprising a second outer shell enclosing a second insulating portion within a second interior of the second outer shell;

a recessed latch slot integrally molded in the first outer shell, wherein the recessed latch slot comprises a first recess defined in the first outer shell of the top portion, wherein the first recess is recessed toward the first interior and wherein the recessed latch slot is configured for receiving the body portion of the latch;

the base portion of the latch is positioned within the recessed latch slot and is attached to the top portion;

the latch pivotally attached to the top portion, the latch comprising a base portion, a body portion extending from the base portion, an engaging portion extending from the body portion, and a grasping portion extending from the engaging portion;

a latch bore formed in the base portion of the latch, wherein the latch bore is configured to align with a bore formed in the top portion, and wherein the latch bore and the bore are configured to receive a latch pin configured to attach the base portion of the latch to the top portion;

a latch keeper integrally molded within the bottom portion, the latch keeper comprising a vertically elongated keeper slot and a recessed pocket formed in the keeper slot, the recessed pocket configured for receiving the engaging portion of the latch, and the keeper slot configured for receiving the body portion of the latch;

wherein the engaging portion has a geometric shape and the recessed pocket is shaped to receive the geometric shape and to provide at least a partial surface-to-surface contact with the geometric shape of the engaging portion when engaged; and a lip extending from an upper edge of the top portion of the container, the rip configured to conceal at least a portion of the base portion of the latch.

31. The insulating container of claim 30 wherein the recessed pocket comprises a pair of opposing recesses defined in opposing sides of the keeper slot at the base of the keeper slot.

32. The insulating container of claim 30 wherein the engaging portion of the comprises a front portion and a rear portion, and wherein the bottom portion comprises a vertical front face of the container, the vertical front face extending from a base of the keeper slot to a bottom base of the container, and wherein the rear portion of the engaging portion does not contact the vertical front face of the container when the latch is engaged.

33. The insulating container of claim 32 wherein the front portion and the rear portion of the engaging portion have a spherical geometric shape.

* * * * *